US005424767A

United States Patent [19]

Alavizadeh et al.

[11] Patent Number: 5,424,767

[45] Date of Patent: Jun. 13, 1995

[54] APPARATUS AND METHOD FOR HEATING INK TO A UNIFORM TEMPERATURE IN A MULTIPLE-ORIFICE PHASE-CHANGE INK-JET PRINT HEAD

[75] Inventors: Nasser Alavizadeh, Tigard; Douglas M. Stanley, Hillsboro; Bryan F. Johnson, Aloha, all of Oreg.

[73] Assignee: Tektronix, Inc., Wilsonville, Oreg.

[21] Appl. No.: 25,292

[22] Filed: Mar. 2, 1993

[51] Int. Cl.[6] ..... B41J 29/38

[52] U.S. Cl. ..... 347/17; 347/60; 347/88

[58] Field of Search ..... 346/1.1, 75, 140 R; 219/216, 390, 528, 543, 548, 549; 347/17, 35, 60, 88, 99, 40, 42

[56] References Cited

U.S. PATENT DOCUMENTS

| | | | |
|---|---|---|---|
| 4,395,146 | 7/1983 | Arai | 219/216 X |
| 4,418,355 | 11/1983 | DeYoung et al. | 346/140 R |
| 5,083,143 | 1/1992 | Hoffman | 346/139 R |
| 5,087,930 | 2/1992 | Roy et al. | 346/140 R |
| 5,285,049 | 2/1994 | Fukumoto et al. | 219/543 X |

FOREIGN PATENT DOCUMENTS

| | | | |
|---|---|---|---|
| 0353925 | 2/1990 | European Pat. Off. | 346/140 R |
| 0505154 | 9/1992 | European Pat. Off. | 347/17 |

*Primary Examiner*—Benjamin R. Fuller
*Assistant Examiner*—John E. Barlow, Jr.
*Attorney, Agent, or Firm*—Ralph D'Alessandro

[57] ABSTRACT

A multiple-orifice phase-change ink-jet print head (28, 44) is heated by a composite laminate heater (29, 58) having multiple heating zones (31–31K, Z1–Z28) spanning the X- and Y-directions of the print head. The print head has multiple rows of ink-jet orifices (34, 46) spread across its face in the Y-direction with the ink in each orifice in each row requiring substantially the same temperature to ensure a uniform jetting velocity from every orifice. In one embodiment, the print head is in fluid communication with a thermally massive multicolor ink reservoir (52) that conducts heat through a region of contact (92) with the print head. A rotating drum (32), spaced across a gap (90) from the print head, draws air through the gap thereby cooling the print head differentially in the Y-direction. Radiation and convection are further thermal transfer mechanisms that contribute to a nonuniform temperature throughout the print heads. The heating zones of the print head heaters compensate for the various thermal transfer mechanisms to cause a uniform temperature throughout the print heads. A temperature controller (16) requires only a single temperature sensor (18, 104) to regulate print head temperature.

23 Claims, 5 Drawing Sheets

APPARATUS AND METHOD FOR HEATING INK TO A UNIFORM TEMPERATURE IN A MULTIPLE-ORIFICE PHASE-CHANGE INK-JET PRINT HEAD

TECHNICAL FIELD

This invention relates to phase-change ink-jet printing and more particularly to an improved heater for heating the ink in a multiple-orifice ink-jet print head to uniform temperature throughout the print head.

BACKGROUND OF THE INVENTION

Previously known apparatus and methods provide phase-change ink to a multiple-orifice ink-jet print head, apply heat to melt the ink in a controlled manner, and selectively jet the melted ink toward a print medium to form a printed image. Phase-change ink is particularly advantageous because of its convenience, image quality, economy, and use of conventional print media.

In particular, U.S. Pat. No. 4,418,355 for an INK JET APPARATUS WITH PRELOADED DIAPHRAGM AND METHOD OF MAKING SAME describes a multiple-orifice ink-jet print head having an elongated serpentine-shaped heater element pressed against a heat-spreading ink reservoir wall plate for melting phase-change ink contained in the reservoir. A thermistor is inserted into a centrally located well in the ink reservoir wall plate to sense the ink reservoir temperature. The ink-jet print head reciprocates back and forth across a print medium while selectively jetting ink from piezoelectric transducer-driven jets to print an image.

Skilled workers know that an ink-jet head ejects ink drops at a velocity that is determined by various parameters including the energy imparted to the ink by the piezoelectric transducer, the geometry of features in the head, and the ink viscosity. In particular, the viscosity of phase-change ink varies widely with temperature, a typical ink being solid at room temperature, rubbery near its 86 degree Celsius melting point, and a flowing liquid at its jetting temperature of about 130 degrees to about 140 degrees Celsius. Given a typical ink-jet head and a fixed amount of transducer energy, ink drop ejection velocity changes about two to about three percent per degree Celsius.

Because the ink-jet print head moves relative to the print medium while ejecting drops of ink, the landing points of the drops will vary in proportion to changes in drop ejection velocity. Therefore, to ensure acceptable drop landing accuracy, the phase-change ink temperature should be regulated and should be substantially the same for each jet of the multiple-orifice ink-jet print head. Ink temperature variations of greater than about three degrees Celsius can cause visible ink drop landing errors.

Factors causing temperature nonuniformity from jet to jet include nonuniform heat conduction losses, convection losses into the air, and radiation losses from the print head into adjacent objects. Convection losses are especially nonuniform in printers using a print head that reciprocates back and forth, thereby "fanning" the leading and trailing edges of the print head more than its central portions.

Maintaining substantially the same ink temperature for each ink jet becomes more difficult as the print head become wider to accommodate additional ink-jet orifices. U.S. Pat. No. 5,087,930 for a DROP-ON-DEMAND INK JET PRINT HEAD, which is assigned to the assignee of this application, describes a 95-millimeter wide, 96-orifice print head designed for ejecting phase-change inks. The ink-jet print head is attached to an ink reservoir which is mounted on a reciprocating carriage as described in U.S. Pat. No. 5,083,143 for ROTATIONAL ADJUSTMENT OF AN INK JET HEAD, which is assigned to the assignee of this application.

Differentially heating the 96-orifice print head to achieve a uniform ink temperature throughout the print head can be accomplished by multiple heaters, each controlled in response to a temperature sensor located adjacent to the particular heater. However, such an approach is unnecessarily complex and expensive.

Referring to FIG. 1, a prior art heater 10 was developed that generates more heat at its edges near its shorter side margins than at its central portion. A single heater foil 12 compensates for nonuniform convection losses near the shorter side margins of the 96-orifice print head and is regulated by a temperature controller employing a single sensor. Heater 10 is a conventional flex circuit in which heater foil 12 is formed from etched Inconel® (alloy 600) foil material laminated between a pair of Kapton® insulating layers. A heat-spreading copper foil layer is bonded to one of the Kapton® layers. Heater 10 is sized to match a major surface of the 96-orifice print head.

Heater foil 12 is electrically connected by a pair of contacts 14 to a temperature controller 16. Temperature controller 16 applies a pulse-duration modulated voltage across contacts 14 in response to the temperature sensed by a thermistor 18. Heater foil 12 has a set of eleven adjacent heating zones 20 (shown generally as regions bounded by dashed lines) spaced across the X-dimension (width) of heater 10. Because electrical current flow is equal everywhere along heater foil 12, the watt-density in any zone 20 is proportional to the electrical resistance of heater foil 12 in that zone. The resistance of heater foil 12 is, therefore, made larger in heater zones 20 near contacts 14 than in heater zones 20 near thermistor 18. The watt-densities of heater zones 20 vary from about 2 to 2.5 watts per square centimeter near the center of heater 10 to about 3 to 3.25 watts per square centimeter at its left and right edges.

Thermistor 18 is embedded in a well in the 96-orifice print head. Access to thermistor 18 is gained through a cutout region 22 in heater 10. The location of thermistor 18 is not critical outside of the intended control area because the temperature sensed anywhere along the width of the 96-orifice print head is equalized elsewhere along the width of print head by the zoned watt-density of heater 10. Because the phase-change ink is in intimate contact with the print head, equalizing the print head temperature also equalizes the ink temperature.

FIG. 2 shows a temperature contour profile across an orifice surface 24 of the 96-orifice print head heated by heater 10 as determined by infrared scanning measurements. Two-degree Celsius contour lines 26 show that the temperature across orifice surface 24, varies by about four degrees Celsius from a centrally located hot area 27 to edge margins 28 of the print head. Note that the orifices span an oblique region of orifice surface 24 that has a greater than four degree Celsius temperature variation. A further improvement in temperature uniformity would improve the consistency of the ink drop time to paper and, therefore, the drop landing accuracy for the 96-orifice print head.

It is also known that certain phase-change inks decompose if kept at an elevated temperature for extended periods of time. For this reason, predetermined amounts of phase-change ink are melted and stored in a reservoir at a temperature slightly above the ink melting temperature, but significantly below the ink jetting temperature. This requires that the reservoir and print head be thermally isolated and have separate heaters and temperature sensors.

Copending U.S. patent application Ser. No. 07/965,812 filed Oct. 23, 1992, for a METHOD AND APPARATUS FOR PROVIDING PHASE CHANGE INK TO AN INK JET PRINTER, which is assigned to the assignee of this application, describes an ink-jet head assembly having a premelt chamber, ink reservoir, and thermally isolated ink-jet print head. A printer using the ink-jet head assembly has start-up, idle, ready, and shutdown modes with each mode defining predetermined temperatures for the reservoir and print head. For example, in idle mode, the print head is kept at the same temperature as that of the reservoir, but when required to print, the print head temperature is rapidly elevated to bring the ink therein to its jetting temperature. The print head and its heater, temperature sensor, and temperature controller have a rapid thermal response time that reduces the time required to enter the ready mode and which acts to preserve the ink.

Phase-change ink-jet printers with reciprocating print heads produce high-quality images, but require a relatively long time to print each image. Print time can be shortened by increasing the number of jets printing the image. An ideal print head would span the full width of a print medium with ink-jet orifices spaced one picture element (hereafter "pixel") apart and would require only one scan of the print head relative to the print medium to print an image. What is needed, therefore, is a substantially media-width, multiple-orifice, ink-jet print head having a heating system that heats the print head, and the phase-change ink contained therein, to a uniform temperature throughout the print head.

SUMMARY OF THE INVENTION

An object of this invention is, therefore, to provide an apparatus and a method for heating a media-width phase-change ink-jet print head, and the phase-change ink contained therein, to substantially the same temperature throughout the print head.

Another object of this invention is to provide an apparatus and a method for heating a phase-change ink-jet print head that has multiple color arrays of orifices spanning X-, Y-, and oblique directions of a major face of the head.

A further object of this invention is to provide an apparatus and a method for rapidly regulating the temperature of a multiple-orifice phase-change ink-jet print head with a temperature control system having a single heater and temperature sensor.

One embodiment of this invention uses a flexible composite laminate heater having multiple heating zones distributed across the X- and Y-directions of a multicolor, media-width phase-change ink-jet head. The print head has two rows of ink-jet orifices spread obliquely across its face with the ink in each orifice in each row requiring substantially the same temperature to ensure a uniform jetting velocity from every orifice. The print head is of a laminated stainless steel plate construction that is susceptible to developing hot spots. Radiation, conduction, and convection losses are thermal transfer mechanisms that contribute to a nonuniform temperature throughout a print head. Heating zones in the print head heater compensate for the various thermal transfer mechanisms to cause a uniform temperature throughout the print head. The temperature controller requires only a single temperature sensor to regulate the print head temperature.

Another embodiment of this invention uses a flexible composite laminate heater having multiple heating zones distributed around an orifice perimeter of the X- and Y-directions of a multicolor, media-width phase-change ink-jet head. The print head has multiple rows of ink-jet orifices spread across its face in the Y-direction with the ink in each orifice in each row requiring substantially the same temperature to ensure a uniform jetting velocity from every orifice. The print head is in fluid communication with a thermally massive multicolor ink reservoir that conducts heat through a region of contact with the print head. A rotating drum, spaced across a gap from the print head, draws air through the gap, thereby cooling the print head by convection differentially in the Y-direction. Radiation and conduction are further thermal transfer mechanisms that contribute to a nonuniform temperature throughout a print head. The heating zones of the print head heater compensate for the various thermal transfer mechanisms to cause a uniform temperature throughout the print head. The temperature controller requires only a single temperature sensor to regulate the print head temperature.

Additional objects and advantages of this invention will be apparent from the following detailed description of a preferred embodiment thereof which proceeds with reference to the accompanying drawings.

DETAILED DESCRIPTION OF PREFERRED EMBODIMENTS

Figure 1:
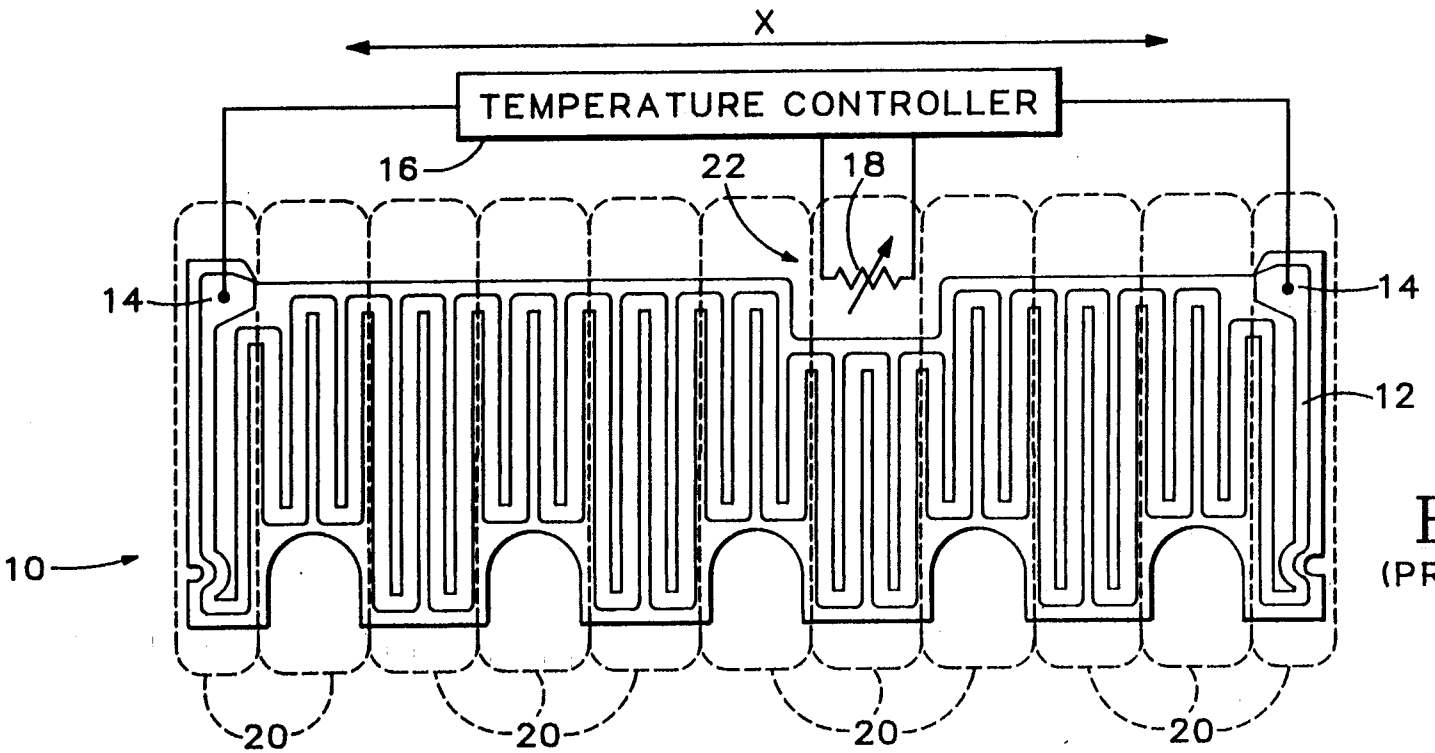
FIG. 1 (PRIOR ART)
FIG. 1 is a pictorial plan view of a prior art ink-jet print head heater element having heating zones spaced across the width of the print head and showing schematically the electrical interconnection of the heater element with a temperature controller and a temperature sensor.
Figure 3:
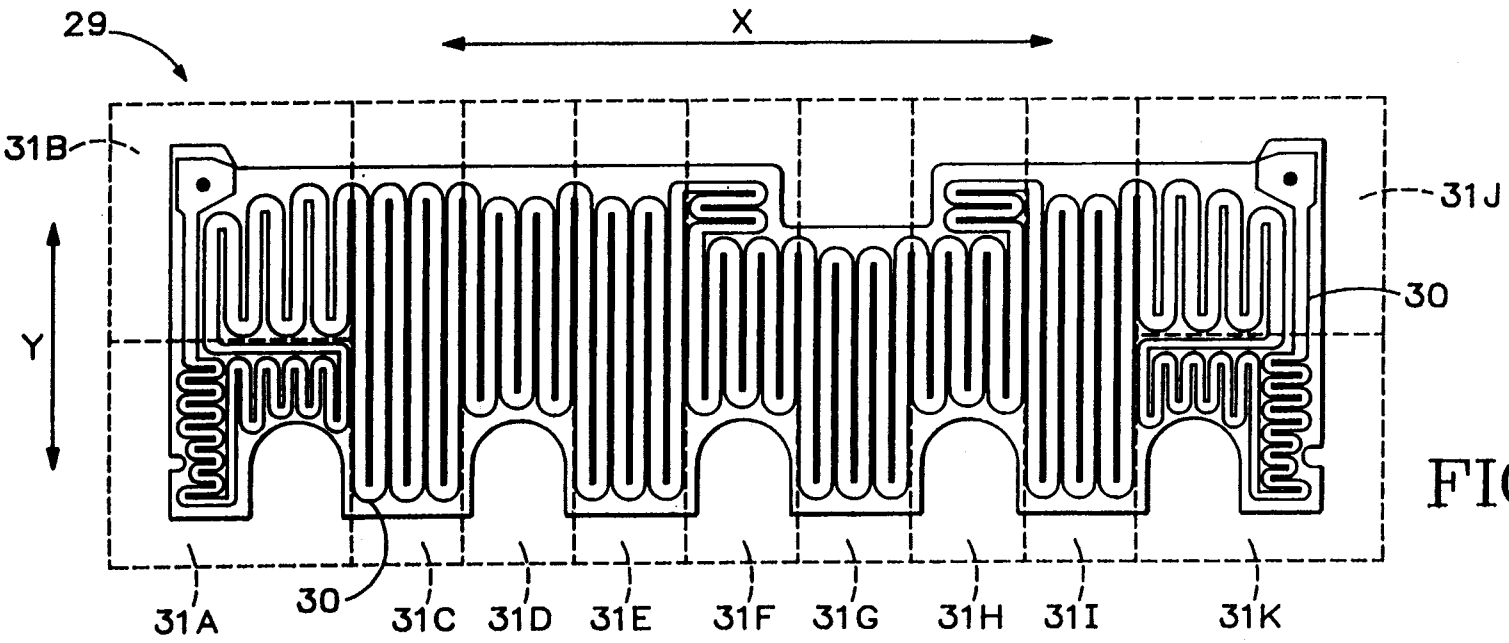
FIG. 3 is a pictorial plan view of an ink-jet print head heater element having heating zones distributed across the width and height of the heater element according to a first embodiment of this invention.

FIG. 3 shows an improved heater 29 for use with a print head such as the 96-orifice ink-jet print head. Improved heater 29 not only generates more heat at its edges near its shorter side margins than at its central portion, but also generates more heat near the lower ends of the side margins. A single serpentine-shaped heater element 30 compensates for nonuniform heat losses distributed across both the width and height of the 96-orifice print head. Improved heater 29 is made as a flex circuit in which heater foil 30 is formed from etched Cupro-Nickel (alloy 70/30) foil material. Cupro-Nickel has a lower resistivity than Inconel ®, thereby allowing heater element 30 to have a smaller cross-sectional area than an equivalent Inconel heater element. The trace width and length of heater element 30 can, therefore, be manipulated to increase the utilization of area on improved heater 29 while maintaining the same total power output as that of prior art heater 10 (FIG. 1). The increased area utilization contributes to improved heat distribution across both the width and height of improved heater 29.

Improved heater 29 includes eleven adjacent heating zones 31A through 31K (shown generally as regions bounded by dashed lines) distributed across the X-dimension (width) and Y-dimension (height) of improved heater 29. Because electrical current flow is equal everywhere along heater foil 30, the watt-density in any of zones 31 is proportional to the electrical resistance of heater foil 30 in that zone. The preferred watt-density values (watts per square centimeter) for heater zones 31 are shown below in Table 1.

TABLE 1

| ZONE NO. NO. | WATT DENSITY |
|---|---|
| 31A | 4.85 |
| 31B | 1.77 |
| 31C | 1.94 |
| 31D | 2.39 |
| 31E | 1.83 |
| 31F | 2.39 |
| 31G | 1.81 |
| 31H | 2.54 |
| 31I | 1.94 |
| 31J | 1.77 |
| 31K | 4.85 |

Figure 2:
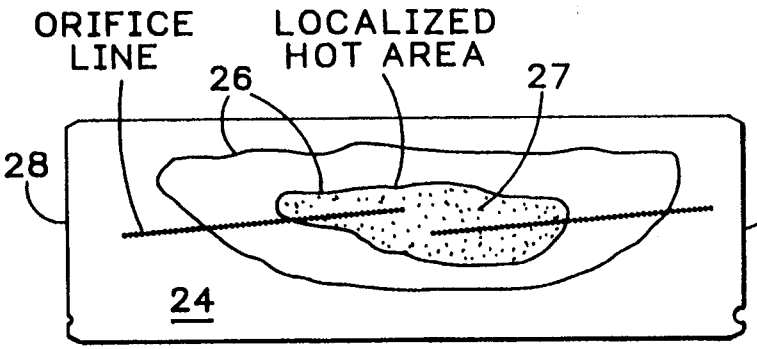
FIG. 2 (PRIOR ART)
FIG. 2 is a pictorial schematic plan view of a 96-orifice ink-jet print head heated by the prior art heater of FIG. 1 showing a nonuniform temperature contour profile across the orifice surface of the print head.
Figure 4:
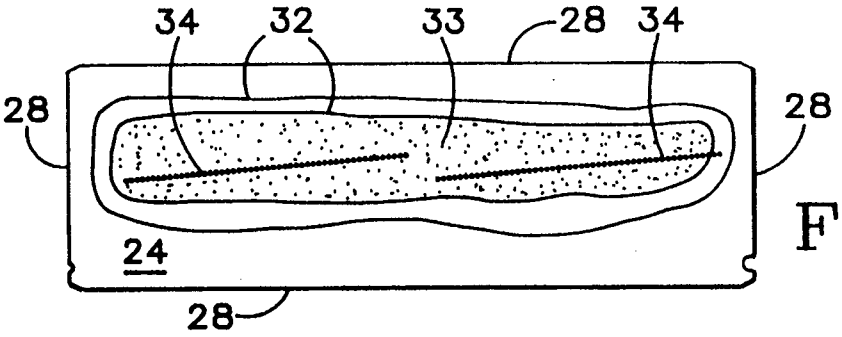
FIG. 4 is a pictorial schematic plan view of the 96-orifice ink-jet print head heated by the heater of FIG. 3 showing an improved temperature contour profile across the orifice surface of the print head.

FIG. 4 shows a temperature contour profile across orifice surface 24 of the 96-orifice print head heated by improved heater 29 (not shown). Two-degree Celsius contour lines 32 show that the temperature across orifice surface 24 varies by about less than three degrees Celsius from a broadly distributed hot area 33 to the edge of the orifice array 34 of the print head. However, unlike the heat distribution of FIG. 2, substantially all of orifice arrays 34 are within hot area 33 primarily as a result of the variable watt density distribution along the multiple axes, thereby improving the temperature uniformity of phase-change ink at locations from which it is ejected from the 96-orifice print head.

Figure 5:
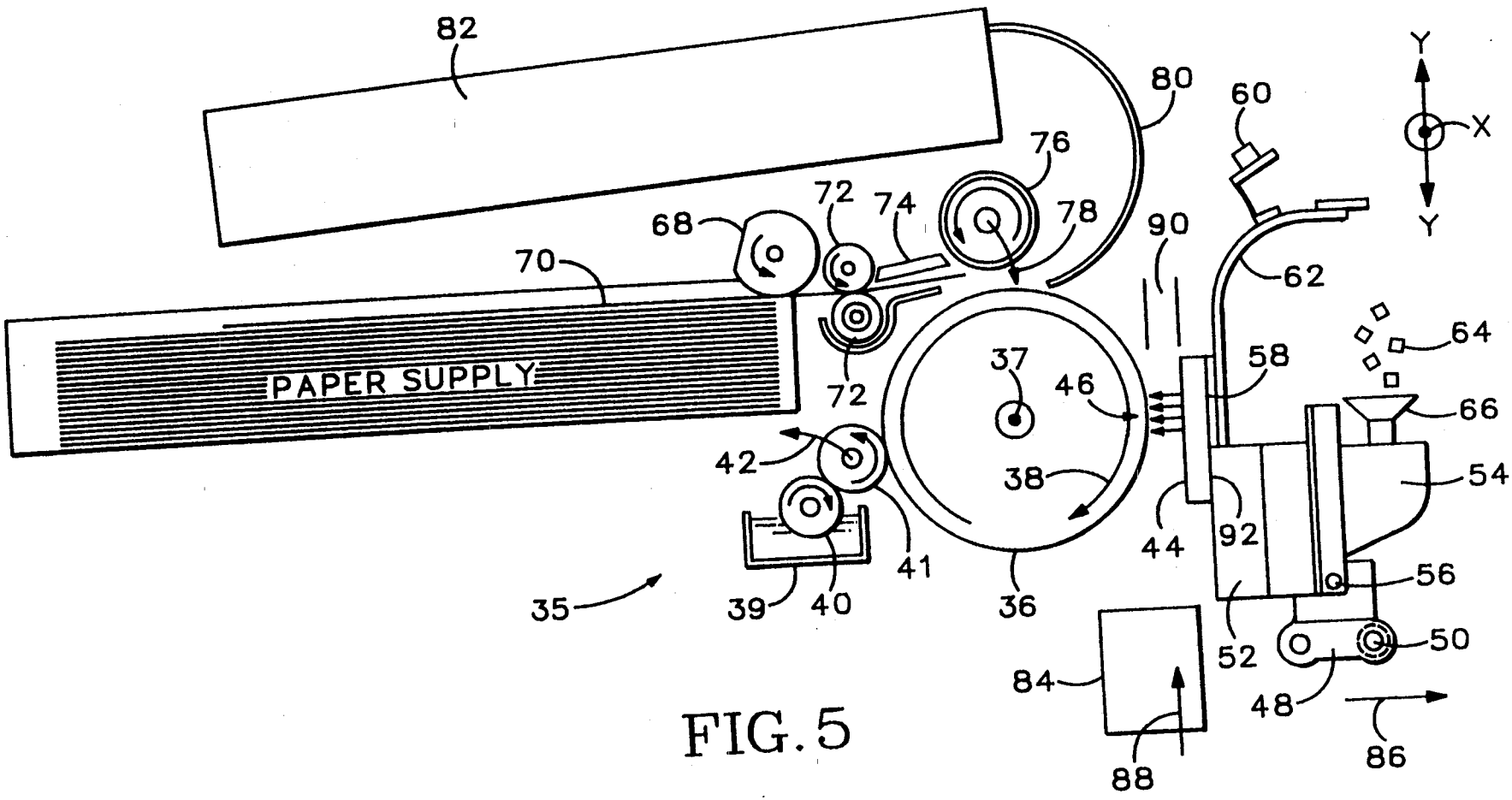
FIG. 5 is a schematic pictorial side elevation view of an offset printing phase-change ink-jet printer mechanism according to a second embodiment of this invention.

Referring to FIG. 5, an offset printing phase-change ink-jet printer 35 (hereafter "printer 35") according to a second embodiment of this invention prints an image according to the following sequence of operations.

An offset printing drum 36 rotates about an axis of rotation 37 in a direction indicated by arrow 38. Prior to printing, drum 36 is wetted with a transfer fluid 39 by transfer fluid applicator rollers 40 and 41 after which transfer fluid applicator roller 41 is moved away from drum 36 in the direction of arrow 42. An ink-jet print head 44 spans the width of drum 36 with four vertically spaced rows of orifices (shown generally at 46). The rows of orifices 46 eject, respectively, yellow Y, magenta M, cyan C, and black K colored phase-change ink. (When necessary hereafter, numbered elements will be further identified by a letter indicating the color of ink carried by the element. For example, orifice row 46C is a cyan orifice row.)

Orifices 46 in each row are horizontally spaced apart by 28 pixel spaces, and the rows are vertically spaced apart by about 24 pixel spaces. Each row of orifices 46 is aligned parallel with axis of rotation 37, and orifice rows 46Y, 46M, and 46C are aligned vertically with the corresponding orifice in the adjacent row. Orifice row 46K is offset horizontally two pixel spaces from the other orifice rows. Vertical alignment of the color rows causes ink drops ejected from a predetermined combination of orifices in rows 46Y, 46M, and 46C to overlay one another when subtractively forming colored images. Black ink drops are offset from the colored images.

Skilled workers will recognize that printing an entire image on drum 36 requires translating print head 44 one pixel position laterally along the length of drum 36 for each of 28 drum rotations. The required translation is accomplished by mounting print head 44 to a carriage 48 which is positioned by a lead screw 50.

Print head 44 is mounted to an ink reservoir 52 which, together with four ink premelt chambers 54 (one shown), is mounted to carriage 48. Reservoir 52 and premelt chambers 54 are heated by a pair of 150 watt cartridge heaters 56 (one shown). Print head 44 is heated by a print head heater 58, which is described with reference to FIGS. 7 and 8. Predetermined amounts of four colors of solid phase-change inks 64 (one color shown) are fed through four funnels 66 (one shown) to premelt chambers 54 where solid inks 64 are melted by heat from cartridge heaters 56. After solid inks 64 are melted, they flow into reservoir 52 and are distributed to print head 44.

Piezoelectric transducers positioned on print head 44 receive image data from drivers 60 mounted on a flex circuit 62. Print head 44 ejects controlled patterns of cyan, yellow, magenta, and black ink toward rotating drum 36 in response to the image data thereby depositing a complete image on the wetted surface of drum 36 during 28 sequential rotations of the drum.

A media feed roller 68 delivers a print medium 70 to a pair of media feed rollers 72 which advance print medium 70, such as paper or transparency film, past a media heater 74 and into a nip formed between drum 36 and a transfer roller 76. Transfer roller 76 is moved into pressure contact with drum 36 as indicated by an arrow 78. A combination of pressure in the nip and heat from print medium 70 causes the deposited image to transfer from drum 36 and fuse to print medium 70. Image transferring heat may also be provided by heating any of rollers 72 or 76 or preferably drum 36. Printed print medium 70 advances into an exit path 80 from which it is deposited in a media output tray 82.

After the image transfer is completed, transfer roller 76 moves away from drum 36 and transfer fluid applicator roller 41 moves into contact with and conditions drum 36 for receiving another deposited image.

To maintain print quality, print head 44 requires periodic cleaning and purging by a print head maintenance station 84. Copending U.S. patent application Ser. No. 07/688,758, filed Apr. 22, 1991, for an INK JET PRINT HEAD MAINTENANCE SYSTEM, assigned to the assignee of this application, describes a print head maintenance station, which, when increased in width to span print head 44, is sufficient for maintaining print quality. Print head maintenance is normally accomplished following cold start-up of printer 35 and proceeds by moving carriage 48 away from drum 36 in a direction indicated by an arrow 86. When print head 44 is a sufficient distance from drum 36, maintenance station 84 is moved in a direction indicated by an arrow 88 into a position adjacent to print head 44.

The heat transfer characteristics of print head 44 in printer 35 are different from those of the reciprocating head type of ink-jet printer described for the prior art reciprocating type print head. In particular, print head 44 does not move at a speed sufficient to cause fanning-induced convection cooling of its left and right edges near its shorter side margins. However, air drawn through a gap 90, by rotation of drum 36, cools print head 44 by convection differentially from top to bottom, as well as by conduction. Moreover, heat is radiated from heated drum 36 into print head 44. The amount of combined heat transfer is greatest adjacent to row of orifices 46M where gap 90 constricts to about 0.51 millimeter. Temperature measurements indicate that the temperature of print head 44 is about two to three degrees Celsius cooler when drum 36 rotates than when it is stationary. Likewise, the temperature of print head 44 is about five to six degrees Celsius cooler when it is moved away from drum 36 for periodic maintenance.

In addition to the above-described heat transfer mechanisms, heat is conducted to print head 44 from reservoir 52 across a region of contact 92 that is located generally below the rows of orifices 46. The portion of print head 44 not in contact with reservoir 52 is exposed to the air and is readily cooled by convection.

Whereas a reciprocating phase-change ink-jet print head utilizes differential heating from its center toward its left and right side margins (X-direction), print head 44 also utilizes differential heating from its center toward its top and bottom side margins (Y-direction). Print head heater 58, therefore, incorporates heating zones that are distributed in both the X- and Y-directions to provide a uniform ink temperature throughout print head 44 thereby ensuring uniform ink viscosity and jetting temperature.

Figure 6:
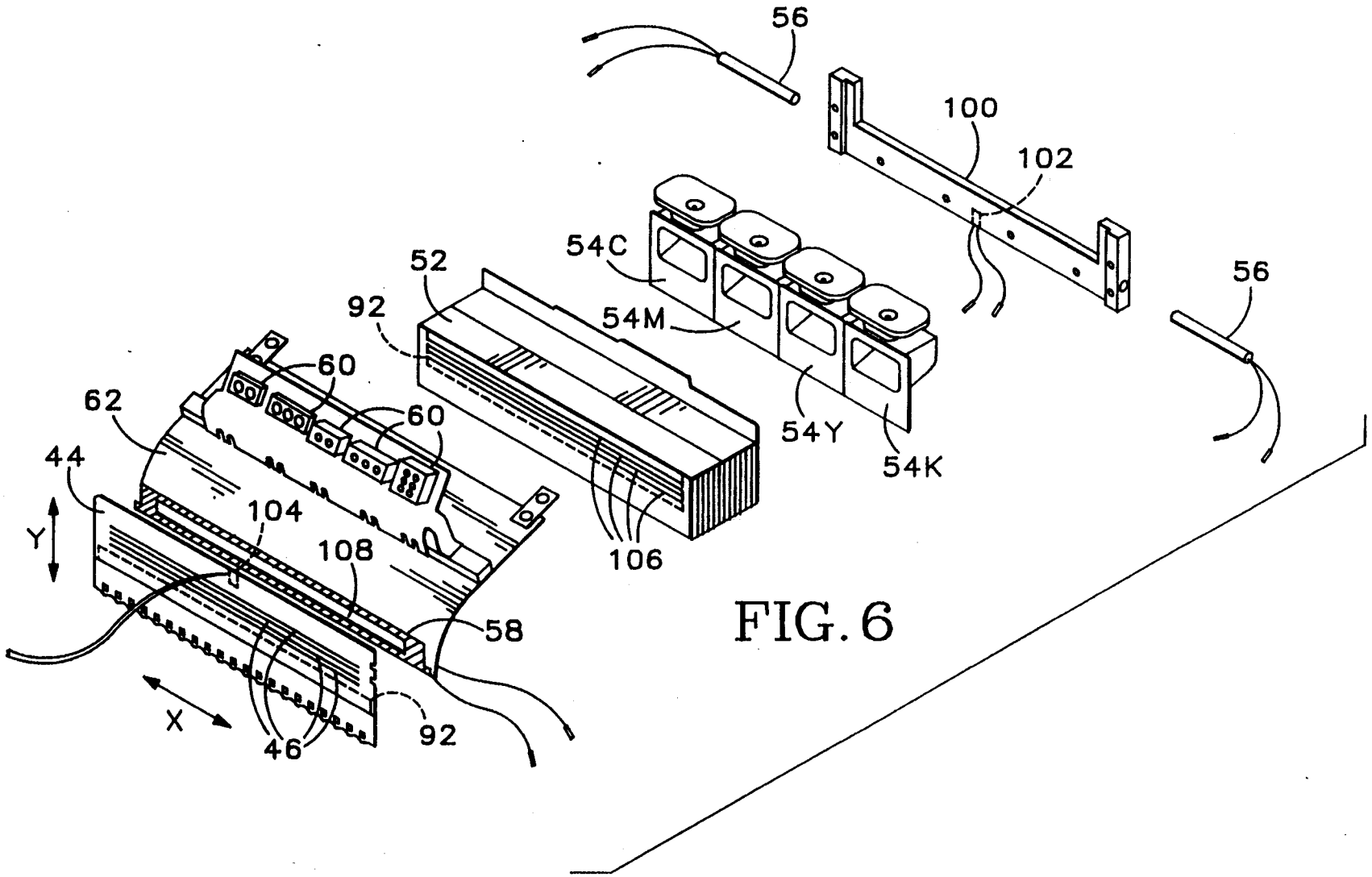
FIG. 6 is an isometric exploded view of an ink-jet print head, heaters, ink reservoir, and ink premelt chambers according to the second embodiment of this invention.

FIG. 6 is an isometric exploded view showing the positioning of media-width print head 44 relative to print head heater 58, flex circuit 62, ink reservoir 52, ink premelt chambers 54C, 54M, 54Y, and 54K, and cartridge heaters 56. Cartridge heaters 56 are inserted into a heat distribution bar 100 that is assembled in thermal contact with reservoir 52 and ink premelt chambers 54. The temperature of heat distribution bar 100 is sensed by a thermistor 102 (shown in phantom) that, in combination with a conventional zero crossing integer cycle temperature controller, regulates the temperature of heat distribution bar 100, reservoir 52, and premelt chambers 54. Their combined thermal mass is such that the temperature controller has a relatively slow 90-second thermal response time, which is sufficient for ink melting, storage, and distribution purposes.

In contrast, print head 44 employs a fast thermal response time of about three to about seven seconds to respond to temperature changes caused by the above-described thermal transfer mechanisms, printer mode-related temperature changes, and heat lost by ejecting dense ink patterns. The temperature of print head 44 is sensed by a thermistor 104 (shown in phantom) that is inserted into a well in print head 44 and controlled as above by the temperature controller which powers print head heater 58. Thermistor 104 is preferably a type 100K6MCD manufactured by Betatherm, Inc., of Shrewsbury, Massachusetts.

Print head 44 is mated to reservoir 52 along a rectangular surface contact region 92 (shown in dashed lines). Contact region 92 on reservoir 52 includes four rows of ink ports 106 through which print head 44 receives melted yellow, magenta, cyan, and black ink. Contact region 92 on print head 44 includes four rows of mating ink ports (not shown) that are separated from and positioned below four rows of orifices 46. The difference of thermal response times on either side of contact region 92 prevents thermal oscillation between the print head and reservoir-related temperature control loops.

Print head heater 58 is bonded to the rear surface of print head 44 just adjacent to and above contact region 92. A cutout region 108 in print head heater 58 accommodates the area required by the piezoelectric transducers (not shown) that drive rows of orifices 46. The piezoelectric transducers are electrically connected to driver circuits 60 by flex circuit 62.

Alternatively, cutout region 108 can be eliminated if print head heater 58 is bonded to the major surface of flex circuit 62 facing away from print head 44. In this embodiment, heat from print head heater 58 conducts through flex circuit 62 and into print head 44 in part through the piezoelectric transducers. The piezoelectric transducers are not good heat conductors, but neither is the stainless steel from which print head 44 is made. This embodiment provides a more direct heat conduction path to ink adjacent to each of orifices 46.

Figure 7:
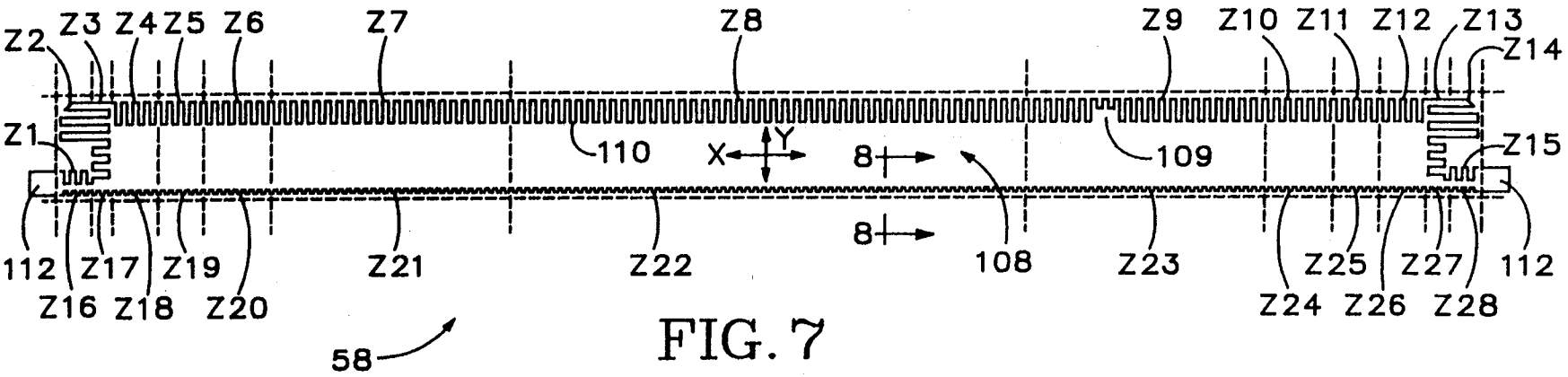
FIG. 7 is a plan view of a flexible heater element having multiple heating zones according to the second embodiment of this invention.

FIG. 7 is a plan view of print head heater 58. Print head heater 58 is divided into 28 heating zones, Z1 through Z28 (shown bounded by dashed lines), that are distributed in X-and Y-directions surrounding cutout region 108. A sensor cutout region 109 located in heating zone Z9 provides access for an optional surface-mount chip-type temperature sensor that can be utilized in place of thermistor 104. A serpentine-shaped heater element 110 is electrically connected to the temperature controller at a pair of contacts 112. The electrical resistance of heater element 110 within a particular heating zone is determined by its composition, cross-sectional area, and length within the zone. The length of heater element 110 in each heating zone is a function of the number of "traces" generated by serpentine reversals of the element, which number is in turn a function of the element spacing between traces.

Heater element 110 is etched from about 0.025-millimeter thick Inconel® (alloy 600) resistance foil material. Heater element 110 is etched to a preferred width, spacing, and resistance value in each heating zone as listed below in Table 2. All resistance values were determined by computer modeling analysis of scanned infrared temperature contour measurements of a solid model of print head 44.

The temperature controller supplies print head heater 58 and cartridge heaters 56 with a zero crossing integer cycle controlled line voltage of nominally 120 AC volts. Skilled workers will recognize that the supplied voltage, temperature control means, and resistance patterns of print head heater 58 can be varied and still achieve the desired result—a uniform ink temperature throughout print head 44.

TABLE 2

| ZONE NO. | NO. OF TRACES | ELEMENT WIDTH | ELEMENT SPACING | RESISTANCE OHMS |
|---|---|---|---|---|
| Z1 | 5 | 0.579 | 0.485 | 1.14 |
| Z2 | 6 | 0.681 | 0.678 | 2.08 |
| Z3 | 11 | 0.564 | 0.795 | 3.75 |
| Z4 | 7 | 0.391 | 0.516 | 4.00 |
| Z5 | 10 | 0.414 | 0.475 | 5.35 |
| Z6 | 14 | 0.424 | 0.485 | 7.31 |
| Z7 | 41 | 0.439 | 0.490 | 20.71 |
| Z8 | 90 | 0.455 | 0.495 | 43.93 |
| Z9 | 41 | 0.439 | 0.490 | 19.68 |
| Z10 | 14 | 0.424 | 0.305 | 7.31 |
| Z11 | 10 | 0.414 | 0.475 | 5.35 |
| Z12 | 9 | 0.391 | 0.516 | 5.11 |
| Z13 | 11 | 0.564 | 0.795 | 3.11 |
| Z14 | 6 | 0.681 | 0.678 | 1.92 |
| Z15 | 5 | 0.579 | 0.485 | 1.32 |
| Z16 | 8 | 0.305 | 0.353 | 1.51 |
| Z17 | 6 | 0.262 | 0.330 | 1.34 |
| Z18 | 8 | 0.330 | 0.462 | 1.50 |
| Z19 | 12 | 0.351 | 0.391 | 2.01 |
| Z20 | 17 | 0.361 | 0.386 | 2.76 |
| Z21 | 50 | 0.376 | 0.386 | 7.81 |
| Z22 | 105 | 0.384 | 0.432 | 16.57 |
| Z23 | 50 | 0.376 | 0.386 | 7.81 |
| Z24 | 17 | 0.361 | 0.386 | 2.76 |
| Z25 | 12 | 0.351 | 0.391 | 2.01 |
| Z26 | 11 | 0.340 | 0.384 | 1.89 |
| Z27 | 5 | 0.262 | 0.330 | 1.09 |
| Z28 | 8 | 0.305 | 0.353 | 4.45 |

Figure 8:
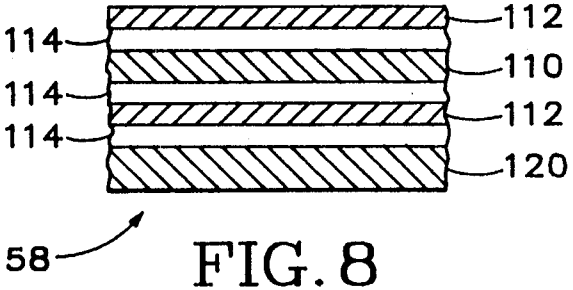
FIG. 8 is an enlarged cross-sectional view taken along lines 8—8 of FIG. 7 showing the laminated layers of the flexible heater element.

FIG. 8 shows a preferred laminated construction of a cross-section of print head heater 58. A 0.05-millimeter thick heat-spreading copper foil layer 120 forms the base of the laminate. Heater element 110 is etched from a layer of about 0.025-millimeter thick Inconel ® (alloy 600) foil and is laminated between two layers of about 0.025-millimeter thick Kapton ® sheeting 112. Copper foil layer 120, heater element 110, and Kapton ® layers 112 are bonded together by layers of about 0.023-millimeter thick WA ® adhesive sheeting 114 to form a composite laminate about 0.20-millimeter thick. Kapton ® and type WA ® sheeting is manufactured by E.I. DuPont de Nemours & Company of Wilmington, Delaware. Copper base layer 120 of print head heater 58 is bonded to print head 44 by another layer of type WA ® adhesive sheeting (not shown) that is preferably not a part of print head heater 58.

Alternative embodiments for portions of this invention include, for example, the use of types of temperature sensors other than thermistors and surface-mount chip-type sensors and the use of more than one sensor as part of the temperature control loop. The location of a temperature sensor on a print head is not critical. Likewise, a print head heater may have a single pair of contacts or may have separate pairs of contacts spanning multiple heating zones (Z1 through Z15 and Z16 through Z28 for the second embodiment). The upper and lower zones may be distributed around the perimeter or throughout an area of a print head. Upper and lower heating zones may also be driven by differing voltages possibly received from separate temperature controllers. The print head heater may be of a type other than the preferred composite laminate. For instance, multiple discrete heaters, properly located and having appropriate watt-densities, would be suitable as would an appropriately trimmed thick-or thin-film hybrid resistor network. Of course, a heater having a tapered, as opposed to a stepped, watt-density distribution is a suitable alternative. Finally, the use of such a print head heater is not limited to ink-jet printers such as printer 35, but is applicable to any type of phase-change ink-jet printer that requires a uniform ink temperature throughout the X-, Y-, or oblique directions of a print head.

It will be obvious to skilled workers that many changes may be made to the details of the above-described embodiments of this invention without departing from the underlying principles thereof. Accordingly, it will be appreciated that this invention is also applicable to temperature regulation applications other than those found in phase-change ink-jet printers. The scope of the present invention should be determined, therefore, only by the following claims.

We claim:

1. Apparatus for maintaining a predetermined ink temperature profile throughout a multiple-orifice, phase-change ink-jet print head, the print head losing heat at different rates from a set of regions distributed along multiple axes of the print head, the print head ejecting molten phase-change ink by the action of piezoelectric transducers, comprising:

a temperature sensor electrically connected to a temperature controller and thermally connected to the print head; and a print head heater electrically connected to the temperature controller, the print head heater having multiple heating zones each in thermal communication with a corresponding region of the print head to maintain the molten phase-change ink in a liquid state at a predetermined ink temperature profile, the heating zones having a proportional watt-density that compensates for the rates of heat loss from each of the regions to maintain the predetermined ink temperature profile throughout the print head to obtain substantially uniform ink drop ejection velocity by maintaining the ink across the orifice array at substantially the same viscosity and the print head orifice array being substantially media-width.

2. The apparatus of claim 1 in which the predetermined ink temperature profile is a substantially uniform.

3. The apparatus of claim 1 in which the heating zones are distributed along an X-dimension spanning substantially a width of a print head orifice array.

4. The apparatus of claim 3 in which the print head orifice array width is at least 24 centimeters.

5. The apparatus of claim 1 in which the heating zones are distributed along an X-dimension and a Y-dimension substantially spanning a respective width and height of the print head.

6. The apparatus of claim 1 in which the heating zones are distributed obliquely along an X-dimension and a Y-dimension substantially spanning a respective width and a height of the print head.

7. The apparatus of claim 1 in which the print head heater is shaped such that the heating zones are distributed around a perimeter of an area that is in thermal communication with a print head orifice array.

8. The apparatus of claim 1 in which the print head heater is shaped such that the heating zones are distributed throughout an area that is in thermal communication with an orifice array.

9. The apparatus of claim 1 in which the heating zones are proportioned to provide a uniformly tapered watt-density distribution in the print head heater.

10. The apparatus of claim 1 in which the print head heater is of unitary construction and is the only heater in thermal contact with the print head.

11. The apparatus of claim 1 in which the print head heater is separated from direct thermal contact with the print head by an intervening substrate.

12. The apparatus of claim 1 in which the print head heater is constructed as a flexible composite laminate having at least one resistance foil heater element that is formed of multiple line portions defined by line-widths and line-spacings between them, either the line-widths or the line-spacings being of varying size to achieve a predetermined electrical resistance value in each of the heating zones.

13. The apparatus of claim 1 in which the temperature controller drives the print head heater with a pulse duration modulated electrical voltage.

14. The apparatus of claim 13 in which the electrical voltage is an alternating current power-line voltage.

15. The apparatus of claim 1 in which the temperature sensor is the only temperature sensor in thermal contact with the print head.

16. The apparatus of claim 1 in which the temperature sensor is in thermal contact with a substantially central location along an X-axis of the print head.

17. The apparatus of claim 1 in which the temperature sensor is a thermistor that is embedded in the print head.

18. The apparatus of claim 1 in which the temperature sensor is of a chip-type that is surface-mounted to a major surface of the print head.

19. The apparatus of claim 1 in which the temperature sensor, temperature controller, and print head heater comprise components of a print head temperature control loop that has a thermal response time not exceeding ten seconds.

20. The apparatus of claim 19 in which the thermal response time has a range of from one to seven seconds.

21. A method for maintaining a uniform ink temperature throughout an orifice array width of a substantially media-width, phase-change ink-jet print head, the print head losing heat at different rates from a set of regions located throughout the orifice array width of the print head, comprising the steps of:

sensing the temperature of the print head;

communicating the sensed temperature to a temperature controller;

controlling a substantially media-width print head heater that is thermally connected to the print head; and partitioning the print head heater into multiple differential heating zones each in thermal communication with a corresponding region of the print head, the differential heating zones compensating for the different rates of heat loss from the set of regions to maintain a uniform molten phase-change ink temperature throughout the orifice array width of the print head to obtain a substantially uniform drop ejection vèlocity of the phase-change ink from the orifice array by the action of the piezoelectric transducers by maintaining the ink across the orifice array at substantially the same viscosity.

22. The method of claim 21 in which the print head loses heat at different rates from a set of regions located throughout the orifice array width and height, and the differential heating zones compensate for the different rates of heat loss from the set of regions, thereby maintaining a uniform ink temperature throughout the orifice array width and height.

23. The method of claim 21 in which the print head has an orifice array width of at least 24 centimeters.

* * * * *